US006098306A

United States Patent [19]

Ramsey et al.

[11] Patent Number: 6,098,306

[45] Date of Patent: Aug. 8, 2000

[54] CLEANING APPARATUS WITH ELECTROMAGNETIC DRYING

[75] Inventors: Michael Ramsey, Osceola, Wis.; John W. Summerfield, Rosemount, Minn.

[73] Assignee: CRI Recycling Services, Inc., Woodville, Wis.

[21] Appl. No.: 09/181,139

[22] Filed: Oct. 27, 1998

[51] Int. Cl.[7] ..... F26B 3/34

[52] U.S. Cl. ..... 34/257; 34/258; 34/351; 134/30

[58] Field of Search ..... 34/245, 255, 256, 34/257, 258, 60, 61, 62, 65, 73, 79, 210, 218, 220, 305, 308, 329, 343, 348, 351; 422/22, 26, 299; 219/686, 729, 736; 134/2, 25.4, 26, 30, 37

[56] References Cited

U.S. PATENT DOCUMENTS

| | | | |
|---|---|---|---|
| 2,198,412 | 4/1940 | McDonald | 34/24 |
| 2,226,871 | 12/1940 | Nicholas | 34/48 |
| 2,360,108 | 10/1944 | Christie et al. | 34/1 |
| 2,405,037 | 7/1946 | Hsu | 219/47 |
| 2,472,193 | 6/1949 | Clayton | 34/257 |
| 2,473,251 | 6/1949 | Hsu | 219/47 |
| 2,560,763 | 7/1951 | Griffith, Jr. | 34/1 |
| 3,267,584 | 8/1966 | Southwell | 34/1 |

(List continued on next page.)

OTHER PUBLICATIONS

"Dielectric Heating: RF and Microwave", by TechCommentary/vol. 4/No. 1, 1993, pp. 1–4.

"Extraction of Coal Tar–Derived SLudges with Liquefied Propane" by, John Markiewicz, Ironmaking Conference Proceedings, 1990, pp. 183–188.

"Propane Extraction Treats Refinery Wastes to BDAT Standards" by, de Fillippi et al., Oil and Gas Journal, Sep. 9, 1991, pp. 52–54.

"Radio–Frequency Heating of Plastics" by, TechCommentary/vol. 4/No. 2, pp. 1–4 (1987).

*Primary Examiner*—Stephen Gravini
*Attorney, Agent, or Firm*—Westman, Champlin & Kelly, P.A.; Peter S. Dardi

[57] ABSTRACT

Dielectric heating is used to assist with the cleaning of sorbent materials contaminated with oils and the like and the recovery of the solvent. In particular, a pressurized system is used such that a pressurized solvent is circulated to remove the contaminants from the sorbent materials. The RF radiation is directed into the vessel to vaporize residual solvents associated with the sorbent materials. Solvent is separated from the removed contaminants for reuse. RF radiation can be used to complete the removal of volatile compounds from the reclaimed oil/contaminants.

20 Claims, 4 Drawing Sheets

U.S. PATENT DOCUMENTS

| | | | |
|---|---|---|---|
| 3,605,272 | 9/1971 | Boucher | 34/1 |
| 3,629,948 | 12/1971 | Hilton et al. | 34/1 |
| 4,057,907 | 11/1977 | Rapino et al. | 34/4 |
| 4,250,628 | 2/1981 | Smith et al. | 34/1 |
| 4,313,786 | 2/1982 | Smith | 159/22 |
| 4,334,136 | 6/1982 | Mahan et al. | 219/10.55 |
| 4,356,640 | 11/1982 | Jansson | 34/1 |
| 4,400,604 | 8/1983 | Ohtsuka et al. | 219/10.55 |
| 4,401,708 | 8/1983 | Paul | 428/198 |
| 4,456,065 | 6/1984 | Heim et al. | 166/248 |
| 4,490,923 | 1/1985 | Thomas | 34/1 |
| 4,510,361 | 4/1985 | Mahan | 219/10.55 |
| 4,510,697 | 4/1985 | Beasley et al. | 34/1 |
| 4,523,387 | 6/1985 | Mahan | 34/1 |
| 4,703,565 | 11/1987 | Kantor | 34/1 |
| 4,734,541 | 3/1988 | Moran, Jr. | 174/25 |
| 4,765,066 | 8/1988 | Yoon | 34/1 |
| 4,765,257 | 8/1988 | Abrishamian et al. | 110/346 |
| 4,770,780 | 9/1988 | Moses | 210/634 |
| 4,771,156 | 9/1988 | Strattan et al. | 219/10.55 |
| 4,805,317 | 2/1989 | Inglis et al. | 34/1 |
| 4,829,679 | 5/1989 | O'Connor et al. | 34/1 |
| 4,848,918 | 7/1989 | Kingsley et al. | 366/12 |
| 4,877,530 | 10/1989 | Moses | 210/262 |
| 4,896,010 | 1/1990 | O'Connor et al. | 219/511 |
| 5,024,004 | 6/1991 | Jaegger | 34/1 |
| 5,074,055 | 12/1991 | Peraniitty et al. | 34/1 |
| 5,174,864 | 12/1992 | Arbizzani et al. | 202/175 |
| 5,187,879 | 2/1993 | Hoist | 34/1 |
| 5,191,721 | 3/1993 | Incorvia et al. | 34/1 |
| 5,220,813 | 6/1993 | Chen et al. | 68/3 |
| 5,267,455 | 12/1993 | Dewees et al. | 68/5 |
| 5,270,509 | 12/1993 | Gerling | 219/10.55 |
| 5,279,615 | 1/1994 | Mitchell et al. | 8/142 |
| 5,304,253 | 4/1994 | Grant | 134/26 |
| 5,315,765 | 5/1994 | Hoist et al. | 34/260 |
| 5,321,897 | 6/1994 | Hoist et al. | 34/260 |
| 5,325,600 | 7/1994 | Gentile | 34/260 |
| 5,396,715 | 3/1995 | Smith | 34/261 |
| 5,429,665 | 7/1995 | Botich | 95/99 |
| 5,463,821 | 11/1995 | Gauer | 34/261 |
| 5,467,492 | 11/1995 | Chao et al. | 8/159 |
| 5,488,784 | 2/1996 | Woodmansee et al. | 34/193 |
| 5,519,947 | 5/1996 | Paré | 34/263 |
| 5,536,921 | 7/1996 | Hendrick et al. | 219/693 |
| 5,555,641 | 9/1996 | Lee | 34/261 |
| 5,581,903 | 12/1996 | Botich | 34/264 |
| 5,606,804 | 3/1997 | Smith et al. | 34/261 |
| 5,647,976 | 7/1997 | Rothe et al. | 210/137 |
| 5,659,972 | 8/1997 | Min et al. | 34/255 |
| 5,661,227 | 8/1997 | Smith et al. | 73/29.01 |

CLEANING APPARATUS WITH ELECTROMAGNETIC DRYING

BACKGROUND OF THE INVENTION

The invention relates to the drying of materials within a closed system. More particularly, the invention relates to the removal of residual solvents after cleaning with pressurized solvent.

Granular sorbent (i.e., absorbent and/or adsorbent) materials include, for example, clay, cellulose, fullers, and diatomaceous earth in compositions which have been processed, i.e., dried or sintered and crushed to the proper size. These granular sorbents are commonly used in garages, industrial facilities and other areas to absorb products such as oil, gasoline and other contaminants that have leaked or spilled. In a typical application of granular sorbent material, after the spill of a product occurs, the granular sorbent material is sprinkled over the spill and the user waits for a short period of time to allow the granular sorbent material to absorb the contaminating product.

After the granular sorbent material has been allowed to absorb the contaminant, the granular sorbent material with the contaminant is swept into a pile and put into a barrel or other receptacle for storage. Thereafter, the facility, which uses the granular sorbent material, would have prior arrangements with a used granular sorbent material disposal service. This disposal service picks up the used granular sorbent material and treats it or disposes of it in a number of ways.

Sorbent mats and pads also are used to absorb contaminants in commercial or industrial sites. The sorbent mats and pads can be cotton, polypropylene, polyethylene, or other fabrics. These sorbent mats and pads are used similarly to granular sorbent materials. After the sorbent mat or pad has absorbed the spilled products, it can be placed in a barrel or other receptacle for storage.

Three primary methods have been used for disposing of used granular sorbent material. A first disposal method is incineration. This method presents environmental problems such as potentially harmful air emissions and the necessity to landfill processed residuals, i.e., ash.

A second common practice for disposing of soiled granular sorbent material is to bury the used material in landfills. This is obviously an undesirable approach because there is the potential for the contamination of groundwater, soil, etc. when burying petroleum-based or other products.

A third alternative method of cleaning granular sorbent material involves exposing the granular sorbent material to genetically altered microbes that consume a contaminant. The purchasing, storage and use of microbes generally are not economically feasible for small shops. In addition, there is the problem of disposing of the used microbes, and equipment used to store the microbes can often be expensive.

Disposal services generally treat sorbent mats and pads by contaminant removal at a laundry service, by incineration, or by landfilling the material. Incineration and landfilling approaches are similar for mats and pads as for granular sorbent materials. The problem associated with contaminant removal with a laundry service is that many of the contaminants are flushed into the sewer system and end up at waste water treatment plants.

SUMMARY OF THE INVENTION

In a first aspect, the invention pertains to an apparatus comprising:

a vessel closed from the ambient environment;

a radio frequency transmitter oriented to direct electromagnetic radiation into the vessel; and a condenser connected to the vessel by way of a conduit.

In another aspect, the invention pertains to a method for drying a material associated with solvent within a vessel sealed from the ambient environment, the vessel being operably connected to a condenser, the method comprising:

applying radio frequency electromagnetic radiation to the vessel to evaporate solvent within the vessel, where the solvent is condensed by the condenser and collected within a storage tank.

In a further aspect, the invention pertains to an apparatus comprising:

a tank with a high surface area material within the tank, and a radio frequency transmitter configured to transmit electromagnetic radiation into the tank.

Moreover, the invention pertains to a method for removing volatile components from an oil, the method comprising:

irradiating a mixture of oil and volatile compounds within a tank with radio frequency electromagnetic radiation.

DETAILED DESCRIPTION OF THE PREFERRED EMBODIMENTS

Figure 1:
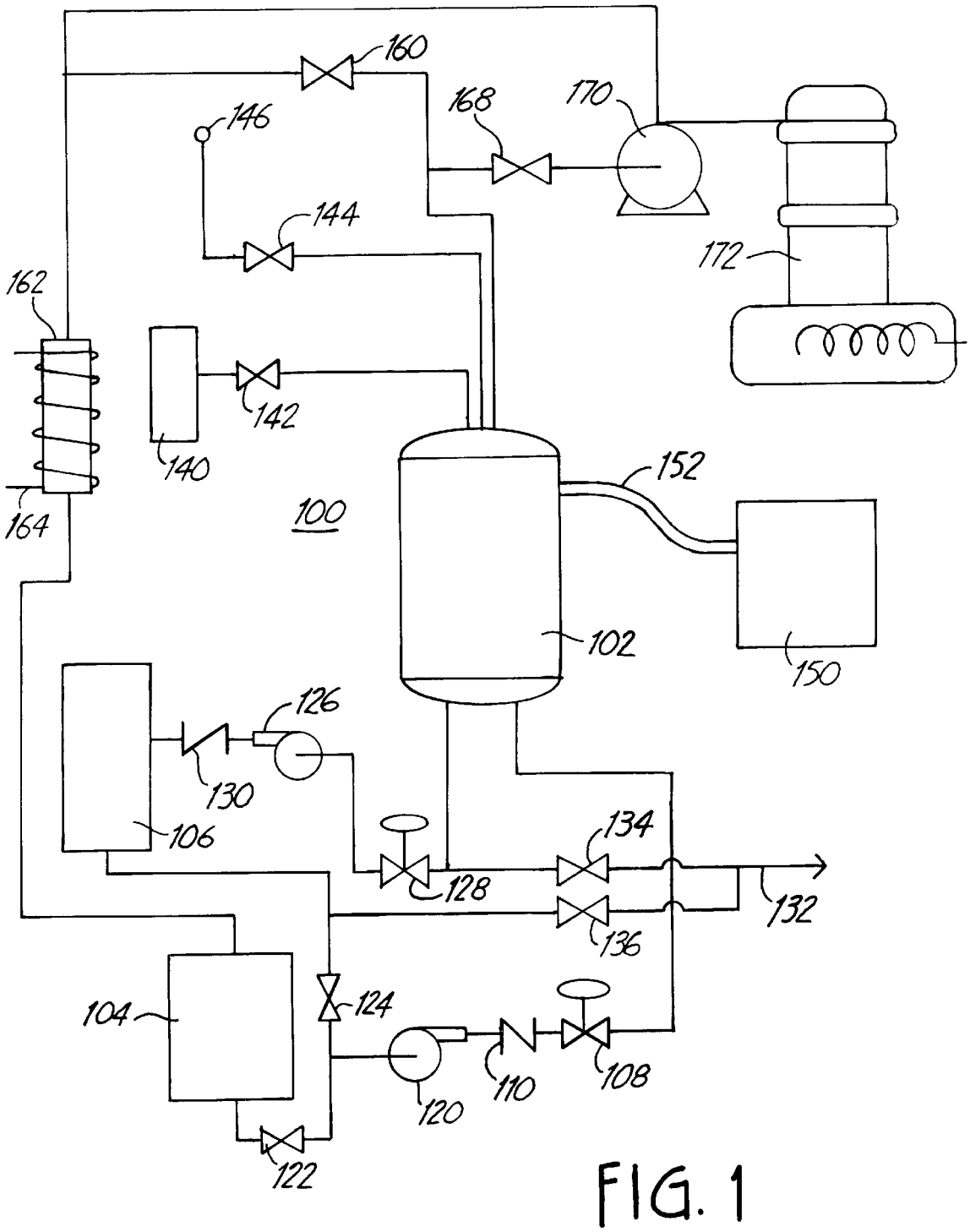
FIG. 1 is a schematic illustration of a pressurized cleaning system.

In a closed system, evaporation of a volatile solvent is hindered by the need to supply the heat of vaporization. It has been discovered that the application of radio frequency electromagnetic radiation is an efficient way to supply the needed heat of vaporization. Pressurized solvents can be used to effectively remove a variety of contaminants. In particular, pressurized solvents have been found to be effective at removing contaminants such as oil from sorbent materials. Sorbent materials retain significant quantities of solvent following drainage of the solvent from a cleaning vessel. Removal of the residual solvent from the sorbent materials is a significant issue with respect to avoiding the waste of the solvent and preventing the release of significant quantities of solvent into the atmosphere.

Following removal of contaminants from the sorbent materials, the solvent/contaminant mixture preferably is processed to separate the solvent from the contaminants such that the solvent and preferably the contaminant can be reused. The contaminants such as oil can be separated from the solvents with a distillation apparatus. Residual solvent, though, following distillation can reduce significantly the flash point of the oil (contaminant) such that the oil cannot be effectively recycled. It has been discovered further that radio frequency electromagnetic radiation can be applied effectively to the oil with residual solvent to reduce further the solvent amount. If the volatile solvents have a significantly higher dielectric constant relative to the oil contaminant, the radio frequency radiation selectively heats the solvent. In this way, the solvent can be removed without the need to expend the considerable amount of energy to heat the entire quantity of oil with the residual solvent.

The cleaning approaches of particular interest involve the use of pressurized solvents within a closed system to remove contaminants from materials. While the materials generally can be anything, preferred materials include sorbent type materials. Typical granular sorbents include ball clay, common clay, shale, fire clay, Fuller's earth, kaolin, cellulose composites, wood chips, corn cob pieces, diatomaceous earth or montmorillonite. Clay and related materials generally are heated prior to use to form a durable sorbent material.

Preferred granular sorbent materials include, for example, processed absorbent clay material. Processed diatomaceous earth and Fuller's earth have good sorbent properties and, thus, are particularly useful as granular sorbent material and also perform well within our cleaning process. Fuller's earth is clay or a clay-like material that is typically high in magnesia. The crystalline structure of Fuller's earth makes it suitable as an industrial process sorbent for applications such as absorbing oil and gas. Typically, clay is mined in Florida or Georgia. Diatomaceous earth generally is mined in the Western United States and is a mineral. Granular sorbent material also may be a combination of different absorbing materials.

For the purposes of this invention, "granular sorbent material" is meant to include sorbent materials, made from any sorbent clay, or other sorbent non-clay materials which may absorb contaminants. Preferred granular materials have an average diameter from about 0.2 mm to about 2 cm and more preferably from about 1 mm to about 1 cm.

The present invention also can be used to clean oil and/or dirt from sorbent articles such as sorbent mats, pads, sorbent booms, or other cloth products. Sorbent mats, pads, rags, socks, booms and the like are made generally from a natural and/or synthetic polymers. These sorbents can be made specifically from cotton, cellulose, polyesters, polyethylene, polypropylene or other similar polymers.

Because of the sorbent nature of the preferred materials, the materials retain a significant quantity of solvent within the sorbent materials after the solvent is drained from the cleaning vessel. While the lowering of the pressure within the system tends to vaporize the residual solvent, sufficient energy must be supplied to supply the heat of vaporization.

Preferred solvents are gases at atmospheric pressure and room temperature. Preferred solvents include, for example, lower molecular weight carbon compounds with 1–5 carbon atoms, although ammonia and derivatives thereof can be used. Preferred solvents include, for example, hydrocarbons and hydrocarbons substituted with halogen, oxygen, nitrogen, or other atoms. Some halogenated solvents have the advantage of being nonflammable. Generally, a solvent should be selected that is nonreactive with respect to expected contaminants. Furthermore, preferred solvents absorb radio frequency (RF) electromagnetic radiation. Solvents with high dielectric constants, which generally have high permanent and/or induced dipole moments, tend to be strong absorbers of RF radiation.

Particularly preferred solvents include, for example, dimethyl ether, butane, isobutane, pentafluoro ethane, 1,1-difluoroethane, 1,1,1,2-tetrafluoroethane, 1,1,1-trifluoroethane, 1,1,2,2-tetrafluoroethane, 2-chloro-1,1,1,2-tetrafluoroethane, 1-chloro-1,1-difluoro ethane, 1,1,2-trifluoroethane, 1,1-dichloro-1-fluoro ethane, chloro difluoro methane, trichloro ethylene, perchloroethylene, trichloroethane and chloroethane. These particularly preferred solvents are generally "inexpensive" and fall within the preferred performance guidelines. Dimethyl ether is an especially preferred solvent for the removal of polar and non-polar contaminants. Common polar contaminants include, for example, water, glycols, and alcohols. Common non-polar contaminants include, for example, petroleum products.

Cosolvents can be used for a variety of reasons and can be selected based on the types of contaminants that are to be removed. Again, it is important to choose a cosolvent which is generally unreactive with respect to common contaminants. Suitable cosolvents include other liquefied gases and/or traditional liquid solvents. Preferred cosolvents include acetone, toluene, hexane, methanol, ethanol, liquefied gases as described above and mixtures thereof. Generally, polar cosolvents would be used to remove polar contaminants and non-polar cosolvents would be used to remove non-polar contaminants. The cosolvent should be miscible in the solvent that is being used. Cosolvents, when used, generally are included in a quantity of about 0.1 to about 50% by weight of the solvent and more preferably from about 0.5% to about 10%. A preferred solvent/cosolvent mixture includes a halogenated hydrocarbon such as 1, 1, 1, 2 tetrafluoro ethane and from about 1% to about 4% by weight dimethyl ether.

Once the solvent has passed through the contaminated porous material, the dissolved contaminants can act as a cosolvent. Thus, the solvent/contaminant mixture can be circulated through a vessel to remove further contaminants. Circulating this mixture of "used" solvent can reduce extraction times and solvent volume by improving the removal of the contaminants which are more difficult to remove such as the "dirts" and higher molecular weight materials. Also, use of the mixture reduces the amount of solvent to be recovered in the solvent recovery portion of the apparatus.

The solvents can be mixed also with surfactants. The surfactants that can be used vary greatly. Suitable surfactants can be used by directly mixing the surfactant with the solvent and/or can be added first to a cosolvent to solubilize the surfactant where the surfactant/cosolvent mixture is added gradually to the solvent. Surfactants are generally used at much lower quantities than the cosolvents. Surfactants are generally not used at levels above about 2–4% by weight of the solvent and typically are used at levels of about 1% or less. Surfactants in particular assist with removing certain types of contaminants including high molecular weight organic and inorganic compounds.

Suitable surfactants can be selected from the large number of known surfactants. Preferred surfactants for use with dimethyl ether solvent include, for example, polyoxyethylene di-nonylphenyl ether phosphate, aromatic phosphate acid esters, and laureth-3 phosphate.

The contaminants can be lubricants, petroleum oils, machine oils, dielectric oils, silicone oils, reflux residues, adhesive residues, plasticizers, fatty materials, waxy materials, or combinations thereof. However, this is not an exhaustive list, and any type of liquid or semi-liquid material may be absorbed by granular sorbent material is envisioned for the present invention.

The cleaning apparatus overall includes a cleaning section and a solvent recovery section. The two sections are in fluid communication with each other, but the two sections can be selectively isolated from each other to carry out separately their respective functions. The cleaning section of the apparatus includes a pressure tank connected to a source of pressurized solvent and a drain connected to the solvent recovery system. The solvent recovery system includes a distillation system to separate the solvent from the contaminants such that the solvent can be recovered and reused.

Generally, the cleaning process is performed in a closed system were selected portions of the system can be closed from or open to other portions to allow for desired processing and for the exchange of materials. The materials to be cleaned (decontaminated) are placed within a tank. Pressurized solvent is placed within the tank to remove the contaminants from the materials. After the cleaning is complete, the solvent is drained from the system. Once the solvent is drained from the pressurized tank at the end of the cleaning cycle, the solvent/contaminant mixture is directed to the solvent recovery section of the apparatus.

Because of the sorbent property of preferred materials for cleaning, a significant quantity of solvent remains within the tank in association with the sorbent materials. The pressurized tank can be vented to a condenser/compressor to draw residual solvent vapors from the pressure vessel. Nevertheless, the heat of vaporization must be supplied to remove a majority of the residual solvent. While superheated gas can be used to supply the heat of vaporization, a large volume of superheated gas may be needed.

The cleaning process can involve the application of heat to the vessel holding the compressed solvent. If the temperature is increased sufficiently during the cleaning process, the heat of vaporization for the solvent can be supplied by the residual heat in the system from the cleaning process. As the temperature is increased, the corresponding pressure required to maintain a solvent in a liquid phase increases. Thus, there are practical limits imposed on the cleaning temperature.

To the extent that additional energy is needed to supply the heat of vaporization, in preferred embodiments a radio frequency (RF) electromagnetic transmitter projects RF radiation into the pressure vessel. Thus, radio frequency electromagnetic radiation supplies the needed heat of vaporization. For preferred polar solvents, the solvent is heated by dielectric heating due to the RF radiation. This dielectric heating supplies the needed energy for the heat of vaporization. The evaporated solvent is vented to the condenser/compressor to recover the solvent.

In general, the solvents used to clean sorbent materials are nonconductive. A dielectric is an electrical insulator that becomes polarized when placed in an electric field. If the electric field is alternating, energy absorbed by the molecules degrades into heat. In particular, the use of radio frequency electric fields to heat dielectric materials has been called dielectric hysteresis heating, dielectric loss heating and dielectric heating. RF heating is minimal for solvents with small dielectric constants and corresponding loss angles, which generally are solvents that are nonpolar. However, molecules of solvents (generally polar) with large dielectric constants (dipole moments), which are trapped within typically sorbent materials with small dielectric constants (dipole moments), can heat and vaporize without significant heating of the surrounding sorbent materials. Thus, the RF heating can be used effectively to evaporate solvents with large dielectric constants without wasting large amounts of energy.

Radio frequencies range from about 10 MegaHertz (MHz) to about 300 MHz. Acceptable frequencies for RF heating are established by the Federal Communications Commission. Within the acceptable values allocated by the FCC, the frequency can be adjusted to increase the absorption by the solvent. To obtain high power densities, the oscillating electric field strength at RF frequencies should be high. The magnitude of the electric field is dependent on the applied voltage. Care should be applied to avoid discharges due to the high electric fields. Traditional dielectric heating uses electric field strengths from about 80 to about 300 V/mm.

The sorbent materials being dried generally have smaller dielectric constants (dipole moments) than preferred solvents and, therefore, have a lower impedance. Thus, once a major portion of the solvent evaporated, the electrical impedance within the pressure vessel decreases. This decreased impedance manifests itself by an increase in current for a fixed voltage and a corresponding increase in power consumption. When an increase in current or power consumption is sensed, the RF transmissions can be reduced or terminated. At the completion of the RF heating, preferably less than about 0.01 grams of solvent, more preferably less than about 0.001 grams of solvent, and even more preferably less than about 0.0001 grams of solvent remain for each gram of sorbents. Small quantities of residual solvent can be removed by passing heated gas through the chamber. More specific details of an embodiment of a cleaning apparatus and the corresponding process are described below.

The solvent/contaminant mixture removed from the cleaning portion of the apparatus is transferred to the solvent recovery portion of the apparatus. The solvent recovery portion of the apparatus preferably includes at least one distillation column. The recovery of the solvent is possible because of the low boiling point of the solvent relative to the contaminants. The solvent/contaminant mixture is heated to evaporate the solvent from the mixture. The evaporated solvent is recondensed for reuse in the cleaning process. After the distillation process is completed, the remaining contaminant can contain residual solvent and volatile contaminants.

In preferred embodiments, two stages of distillation are used. The contaminants are transferred from the first distillation apparatus to the second stage distillation apparatus for further processing. To allow for the removal of additional volatile components, the second stage distillation apparatus generally operates at a lower pressure than the first stage distillation apparatus. Even after processing through two stages of distillation, the contaminants/oil may contain undesirably large amounts of solvent and/or volatile contaminants. Reuse of oil contaminants required the removal of sufficient volatile components from the oil.

Thus, the contaminant/oil with residual volatile solvents can be transferred to a container with an RF heater for removal of additional volatiles. Preferably, the container has a high surface area interior to facilitate vapor formation within the container. Preferred solvents and many residual volatile contaminants may be more polar than components of oils and similar contaminants. The RF dielectric heating tends to preferentially heat the solvent and volatile contaminants. The evaporated solvent and/or volatile contaminants can be recovered for reuse and/or disposal.

While the solvent and volatile contaminant components are present, the bulk oil is not significantly heated since the solvent and volatile components are preferentially heated. Once most of the solvent and volatile contaminants are removed, the RF dielectric heating begins to heat the oil directly. The temperature of the oil can be monitored to indicate that the dielectric heating process can be terminated. Alternatively, the pressure in the system can be monitored to indicate if additional solvent/volatiles are being removed. Similarly, a gas monitor can be used to evaluate the gases being driven from the oil. Preferably, sufficient solvent and volatile contaminants are removed to yield a recovered oil with a flash point greater than about 142° F., such that it would not be classified as a hazardous material, and more preferably greater than about 150° F. In addition, preferably less than about 2 percent water and other nonflammable solvents remains in the oil. Additional features of an embodiment of a solvent recovery system and corresponding processes are described below.

Pressurized Solvent Cleaning and Drying

An apparatus to perform the cleaning operation includes a pressure vessel to hold the materials to be cleaned. A suitable apparatus envisioned for the present invention is a batch system, wherein granular sorbent material or sorbent mats, pads and the like are placed in the pressure vessel at the start of the cleaning process. The vessel generally is capable of holding a pressure between 25 and 500 PSIG (pounds per square inch gage) such that a selected solvent or solvents can exist in a liquefied, supercritical, or near critical state. The vessel temperature depending on the solvent used, ranges from about 70°–250° F.

For dimethyl ether, the preferred temperatures are about room temperature, and the preferred pressures are about 100 PSIG. For 1, 1, 1, 2-tetrafluoro ethane, the preferred temperatures are about room temperature or above, and the preferred pressures are about 100 PSIG or above. The used granular sorbent material or sorbent mats and the like are exposed to the liquefied gases and/or supercritical fluids. A flow of solvent preferably is applied to the extraction vessel. After exposure for approximately 10 minutes or more, the used sorbent material preferably has 80% or more of its contaminants removed.

A general cleaning approach using suitable apparatuses involves the following steps:

(a) Used granular sorbent material or sorbent mats, pads and the like are placed in an extraction vessel, which can be pressurized, i.e., a pressure vessel.

(b) The vessel is closed, and a selected solvent with any cosolvent/surfactant is pumped into the vessel at a prescribed temperature and pressure such that the solvent can exist in a state which allows the solvent to interact with and cleanse the soiled material. The solvent is as a liquefied gas or supercritical fluid.

(c) A flow of purified solvent and/or recirculated solvent is circulated through the pressure vessel and allowed to penetrate the granular sorbent material or sorbent mats or pads for a period of time. During this time the solvent dissolves the contaminants (oils, etc.) and removes them from the absorbent material and from the pressure vessel.

(d) The solvent is drained out of the vessel. Remaining solvent is removed by applying RF heating and collecting the vaporized solvent. Any residual solvent vapor remaining in the vessel can be purged using an inert gas and/or by venting the vessel to the atmosphere or to a flare.

(e) The granular sorbent material or sorbent mats or pads are then removed from the extraction vessel.

(f) A new batch of used granular sorbent material or sorbent mats or pads are then placed in the extraction vessel.

(g) The process is repeated.

Once use of a portion of solvent is complete, the solvent preferably is diverted for recovery. In particular, the solvent can be separated from the contaminants and recycled. The separation is made possible by the selection of a solvent that has a low boiling point at atmospheric pressure. This process is described further below.

An embodiment of a suitable cleaning system 100 is shown in FIG. 1. Contaminated sorbents are placed within pressure vessel 102 for extraction. Cleaning system 100 can include a plurality of pressure vessels 102 to allow for parallel processing of several batches at once. Preferably, pressure vessel 102 is large enough to hold at least the contents of two 55 gallon drums, such that about 110 gallons of contaminated sorbent materials can be processed in a single batch operation. Particular embodiments of pressure vessel 102 are described below. With the contaminated sorbent materials sealed within pressure vessel 102, the pressure is raised to desired values. Optionally, the temperature can be increased.

Apparatus 100 preferably includes two solvent supplies 104, 106. Clean solvent supply 104 holds clean solvent, and used solvent supply 106 holds previously used solvent. The flow of solvent into pressure vessel 102 is controlled with an isolation valve 108 and a check valve 110. Pump 120 supplies solvent to check valve 110. The flow of solvent from clean solvent supply 104 and used solvent supply 106 to pump 120 are controlled by valves 122, 124, respectively.

Solvent from pressure vessel 102 can be drained to used solvent supply 106. Pump 126 assists with the transfer of solvent from pressure vessel 102 to used solvent supply 106. Valve 128 controls the flow from pressure vessel 102 to pump 126. Check valve 130 is located in the flow path from pump 126 to used solvent supply 106. Alternatively, used solvent from the pressure vessel 102 can be directed to the solvent recovery system through pipe 132. Flow through pipe 132 is controlled with valve 134. Similarly, used solvent supply 106 can be drained into the solvent recovery system through pipe 132 through valve 136.

Pressure vessel 102 preferably is connected also to a supply 140 of inert gas by way of one or more valves 142. Inert gas can be used to purge the vessel of residual solvent. Preferably, pressure vessel 102 can be vented through a valve 144 to a vent 146 that can be open to the atmosphere or to a flare.

Pressure vessel 102 is connected to an RF generator 150 by way of cable 152. Cable 152 can be a coaxial cable. The RF generator supplies the voltage needed to perform RF heating of residual solvent within pressure vessel 102. Cable 152 is directly or indirectly connected to electrodes, i.e., transmitting antenna, within pressure vessel 102. Suitable locations of the electrodes are described further below.

Vapor from pressure vessel 102 can be vented through valve 160 to a condenser 162. Condenser 162 includes cooling coils 164. Condensed solvent from condenser 162 can be directed to clean solvent supply 104 or to another suitable solvent holding tank. Alternatively, pressure vessel 102 can be vented to the solvent recovery system. In particular, pressure vessel 102 can be vented through valve 168 to a compressor 170 that is connected to a distillation column 172. Compressor 170 and distillation column 172 can be connected to additional components of a solvent recycling system, as described further below.

Figure 2:
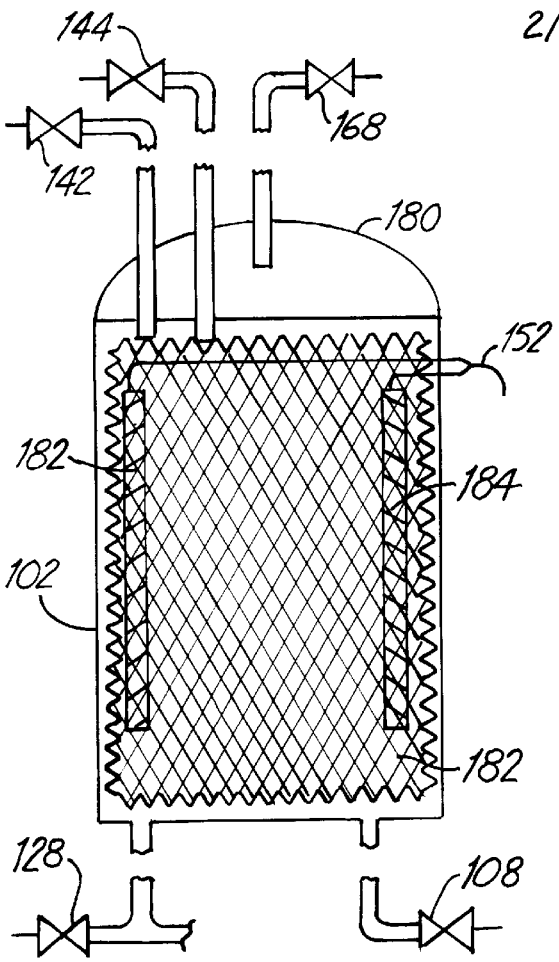
FIG. 2 is a schematic, sectional view of a pressurized vessel with electrodes for RF transmission, where the cross section is taken through the center of the vessel.
Figure 3:
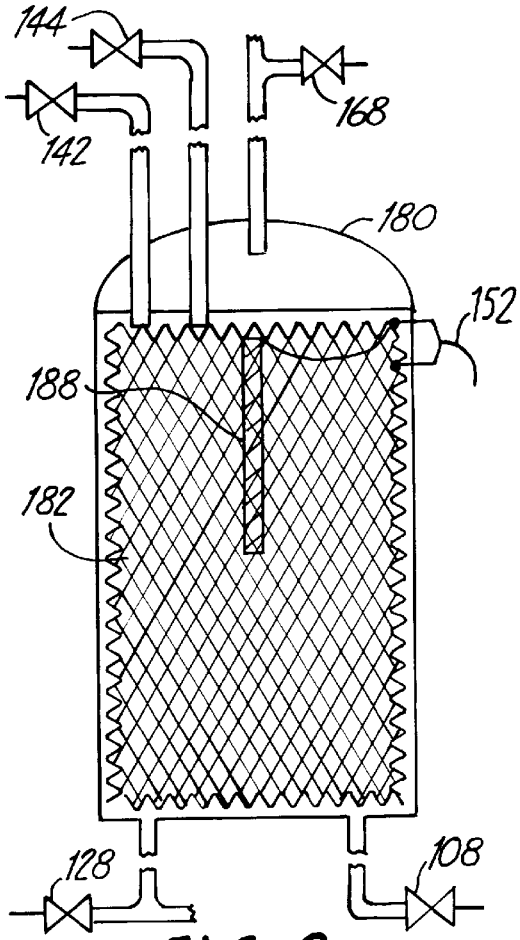
FIG. 3 is a schematic, sectional view of an alternative embodiment of a pressurized vessel with electrodes for RF transmission, where the cross section is taken through the center of the vessel.

Referring to FIGS. 2 and 3, pressure vessel 102 includes a detachable cover 180. The removal of detachable cover 180 provides for access into the interior of pressure vessel 102 for the placement and removal of sorbent materials. In preferred embodiments a basket 182 is located within the interior of pressure vessel 102. Basket 182 is used to facilitate the placement and removal of materials from pressure vessel 102. Generally, basket 182 allows solvent to flow through the basket such that solvent can flow through pressure vessel 102. In particular, the sorbent materials are loaded within basket 182 for cleaning. If basket 182 is designed to act as an electrode for RF transmissions, basket 182 generally is made from corrosion resistant metal such as aluminum. If basket 182 is used to mount opposing electrodes for RF transmission, basket 182 is preferably made from nonconducting materials such as fiberglass, polypropylene and other similar durable polymers.

Cable 152 connects with electrodes within pressure vessel 102. Pressure vessel 102 acts as an electromagnetic shield. The electrodes preferably are placed to transmit a relatively uniform RF field throughout the interior of basket 182. Two particular embodiments are shown in FIGS. 2 and 3. In FIG. 2 electrodes 184, 186 are attached to portions of basket 182. In this embodiment, basket 182 is preferably nonconducting. Electrodes 184, 186 are connected, respectively, to the two polarities of cable 152. Additional electrodes or different placement of electrodes can be used, if desired, to achieve desired levels of heating. Alternatively, the electrodes can be attached within pressure vessel 102 to nonconducting supports separate from a basket used for loading and unloading the sorbent materials.

Referring to FIG. 3, central electrode 188 hangs down within the center of basket 182. In this embodiment, the basket functions as the other electrode. Thus, in this embodiment basket 182 is necessarily electrically conducting. Central electrode 188 and basket 182 are connected to the opposite polarities of cable 152. Generally, basket 182 is electrically grounded. The size, shape, placement and number of components of central electrode 188 can be varied to achieve desired levels and uniformity of heating.

Figure 4:
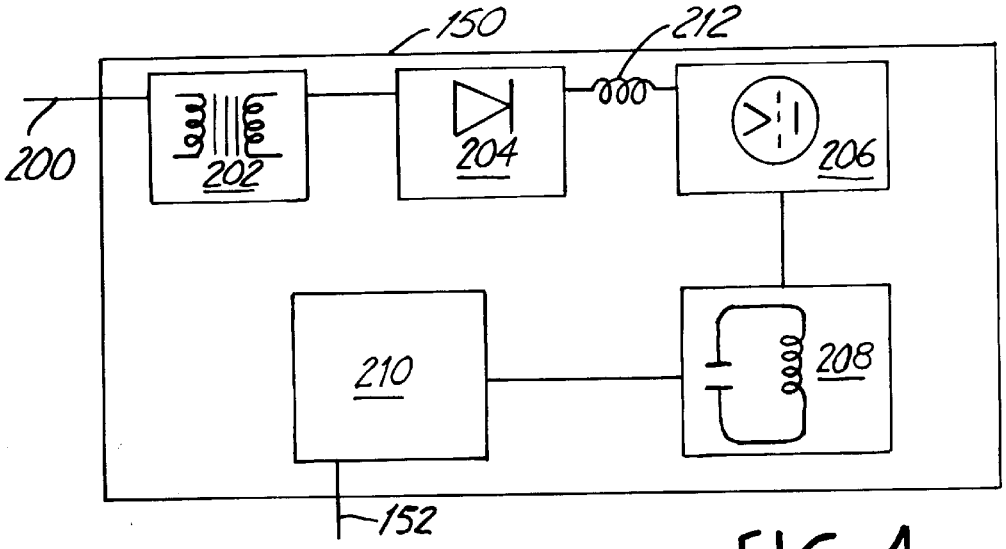
FIG. 4 is a schematic diagram of the components of an embodiment of an RF generator.

A variety of RF generators 150 can be used including conventional RF generators. A general schematic for an embodiment of an RF generator is shown in FIG. 4. Line power is received into RF generator 150 through wire 200. Wire 200 is connected to high voltage transformer 202, which is connected to a rectifier 204. Rectifier 204 is connected to an oscillator 206, such as an electron tube. Oscillator 206 is connected with a tuned circuit 208 to condition the RF modulated current. Matching unit 210 adjusts the parameters of the RF output to obtain efficient heating from the transmitters/electrodes given the particular values of load impedance. Matching unit 210 can include, for example, a transformer, a capacitor and/or an inductor. A variety of other designs can be used for RF generator 150. Heat generated by the RF generator can be diverted to other portions of the facility.

In a preferred embodiment, transformer 202 is a three phase step-up transformer that raises line voltage up to values on the order of 15,000 volts. Rectifier 204 is a three phase bridge rectifier that converts three phase ac power to dc. A choke 212 acting as a line impedance is placed between rectifier 204 and oscillator 206. Oscillator 206 is a self-excited triode oscillator, which produces RF trigger pulses. The tuned circuit creates smooth sinusoidal wave forms from the pulses. The output RF signal generally has a frequency in a range permitted by the Federal Communication Commission or comparable granting agency for the jurisdiction. Furthermore, within the permitted frequencies and to the extent feasible, a frequency can be selected such that the solvent has a high absorption of energy at the frequency and the sorbents have a low absorption.

In operation, a batch of sorbent materials to be recycled are placed within basket 182. Basket 182 is lowered within pressure vessel 102, and the RF electrodes are connected to cable 152. Then, cover 180 is secured to seal pressure vessel 102. Pressure vessel 102 at the desired pressure is flooded with compressed solvent. Solvent and/or solvent/contaminant mixture are circulated through the pressure vessel to extract contaminants from the sorbent materials. After the desired level of contaminant removal is reached, the solvent/contaminant mixture is drained from pressure vessel 102. If solvent/contaminant mixture is flowed through pressure vessel 102, pure solvent preferably is added to pressure vessel 102 to complete the cleaning process and to remove residual contaminants.

Once basket 182 and pressure vessel 102 have been drained of solvent, electromagnetic energy, preferably at radio frequencies, is applied within pressure vessel 102 using suitably located electrodes/transmitters. Pressure within pressurized vessel 102 preferably is maintained at a suitable operating pressure by venting vaporized solvent to a storage tank 104 fitted with a heat exchanger/condenser 162 to condense the reclaimed solvent. As additional solvent is removed from pressure vessel 102, pressure vessel 102 can be connected to a compressor 170 by opening valve 168 and closing valve 160. Compressor 170 reduces the pressure in pressure vessel 102 generally to less than about 500 psig and preferably between about 1 psig and about 120 psig and thereby assists with solvent removal. Solvent passing through compressor 170 is directed to heat exchanger/condenser 162 or to a comparable condenser.

In preferred embodiments, when there is an indication that the vapor flow to the storage tank has slowed or stopped, the RF transmitter is turned off, and remaining solvent vapor is withdrawn via compressor 170. With dimethyl ether solvent, the pressure preferably is reduced to about 5 psig. Preferably, any last solvent vapor is removed then with a short burst, preferably 2 minutes or less, of electromagnetic energy and/or of inert gas. The inert gas/solvent mixture can be vented to the atmosphere or to flare 146. After desired amounts of solvent have been removed, the cleaned sorbent materials are removed from pressure vessel 102. The process can be repeated with another batch of contaminated sorbent materials. Determination that desired amounts of solvent have been removed can be determined by monitoring the pressure within the system, evaluating the impedance of the materials in the tank by the current and/or power associated with the RF generation and or using a gas detector to evaluate whether additional solvent is being drawn from the tank. Gas detectors can be selected based on the solvent, and conventional detectors can be used.

Solvent Recovery and Oil Recycling

The solvent recovery system is connected to the cleaning system, but it can operate independently from the cleaning system. Solvent/contaminant mixtures are brought to the solvent recovery system to separate solvents from the contaminants. The solvent recovery system generally includes a distillation column to provide for separation of the solvent from contaminants.

In preferred embodiments, two sequential distillation columns are used. The second stage of the distillation column operates at lower pressure than the first stage. The second stage removes additional solvent as well as volatile contaminants from the high boiling point contaminants. For oil contaminants, the residual oil from the second stage distillation may or may not be sufficiently purified. Generally, additional purification is desirable. RF heating can be used to separate additional residual solvents and volatile contaminants from the high boiling contaminants. Alternatively, RF heating can replace the second stage distillation column.

Figure 5:
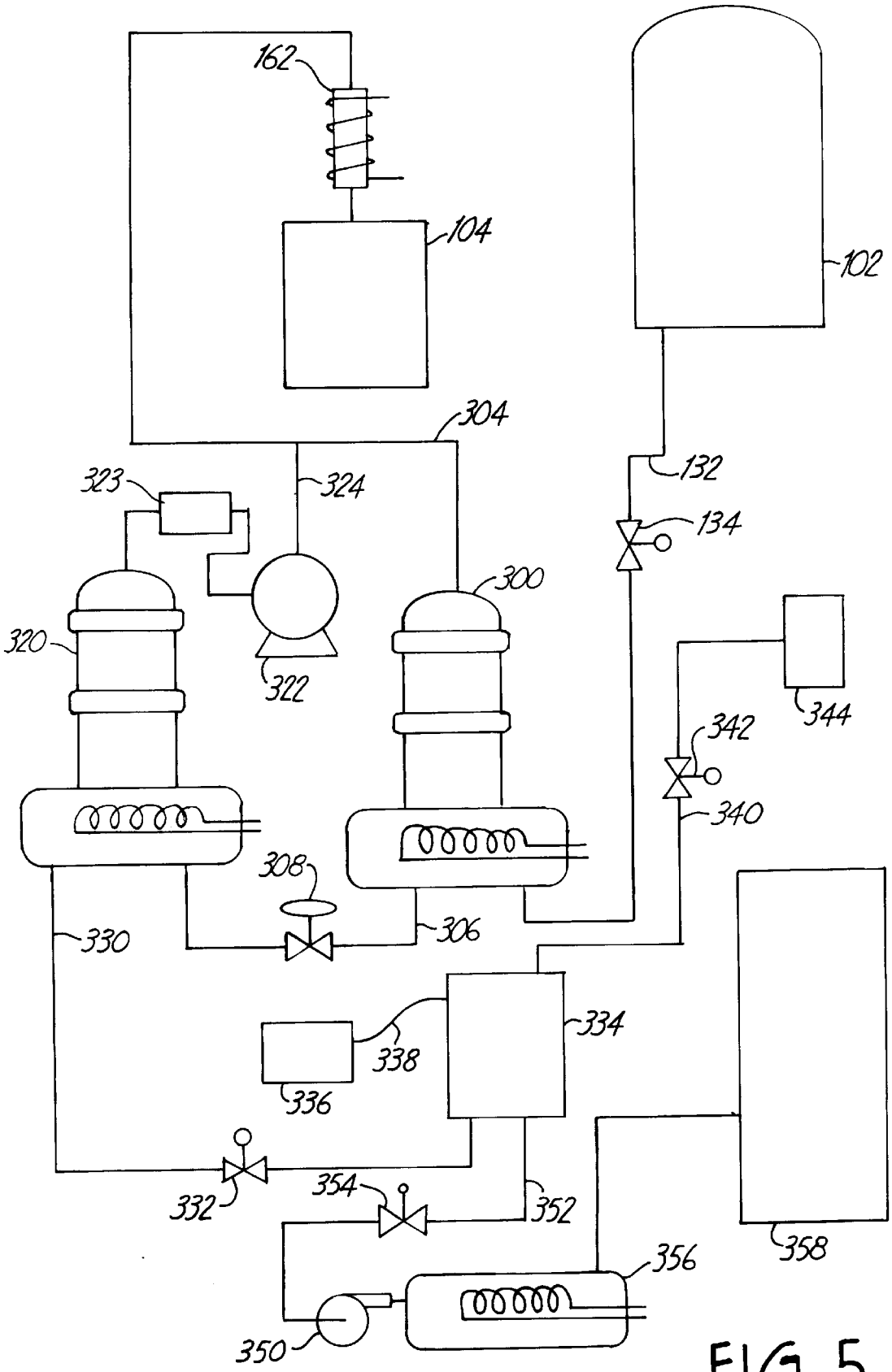
FIG. 5 is a schematic illustration of a closed solvent recovery apparatus.

A specific embodiment is shown in FIG. 5. Solvent/contaminant mixtures flow from pressure vessel 102 through pipe 132 to first stage distillation column 300. Valve 134 controls the flow from pressurized vessel 102 into primary distillation column 300. Primary distillation column 300 generally operates at pressures slightly less than the pressures used in pressurized vessel 102. The pressure differential between primary distillation column 300 and pressure vessel 102 is due to the activity of pumps used transfer fluids within the system. Solvent vaporized in primary distillation column 300 is removed by way of conduit 304 to condenser 162 and storage tank 104. A separate condenser and storage tank can be used, if desired.

First stage purified contaminant is removed from primary distillation column 300 by way of pipe 306 controlled by valve 308. Pipe 306 flows into second stage distillation column 320. Compressor 322 is used to reduce the pressure in second stage distillation column 320. Volatile compounds removed in second stage distillation column 320 pass through knock-out tank 323 where volatile contaminants such as water and low boiling liquids are separated from solvent. Solvent removed by second stage distillation column 320 flows through conduit 324 to conduit 304 and then to condenser 162.

Residual contaminants from second stage distillation column 320 flow through pipe 330 under the control of valve 332. Fluid from pipe 330 flows into separation tank 334. Separation tank 334 has an RF heater that can be used to selectively heat the polar solvents and polar volatile contaminants. Thus, additional polar contaminants and solvent can be removed by RF heating to leave behind purified high boiling contaminants, such as oils. Separation tank 334 is connected to an RF generator 336 by way of coaxial cable 338 or the like. The solvents and volatile contaminants removed from holding tank 334 travel by way of pipe 340 and valve 342 to storage tank 344. Purified oil is removed by pump 350 through pipe 352, valve 354 and cooler 356 into holding tank 358.

Figure 6:
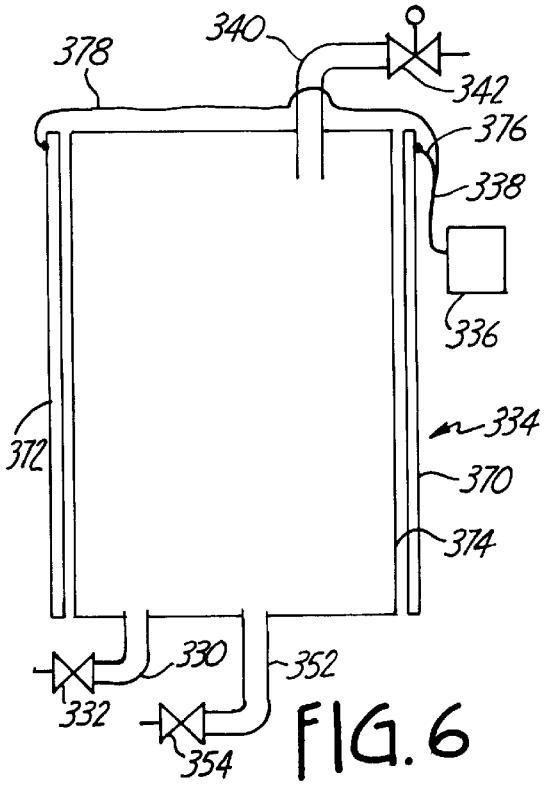
FIG. 6 is a schematic sectional view of a tank with associated electrodes for RF transmission, where the cross section is taken through the center of the tank.

Separation tank 334 includes electrodes for RF heating. Various embodiments can be used for the configuration of separation tank 334 and the corresponding electrodes. In particular, the electrodes can be placed within separation tank 334 or electrodes can be placed around the outside of separation tank 334. Referring to FIG. 6, an embodiment of separation tank 334 includes electrodes 370, 372, such as planar electrodes, on either side of vessel 374. Electrodes 370, 372 are connected to cable 338 with wires 376, 378. A suitable RF generator 336 was described above in reference to FIG. 4. Vessel 374 should be made of a material that transmits most of the RF radiation. Suitable materials include, for example, fiberglass and other sturdy plastic materials.

Figure 7:
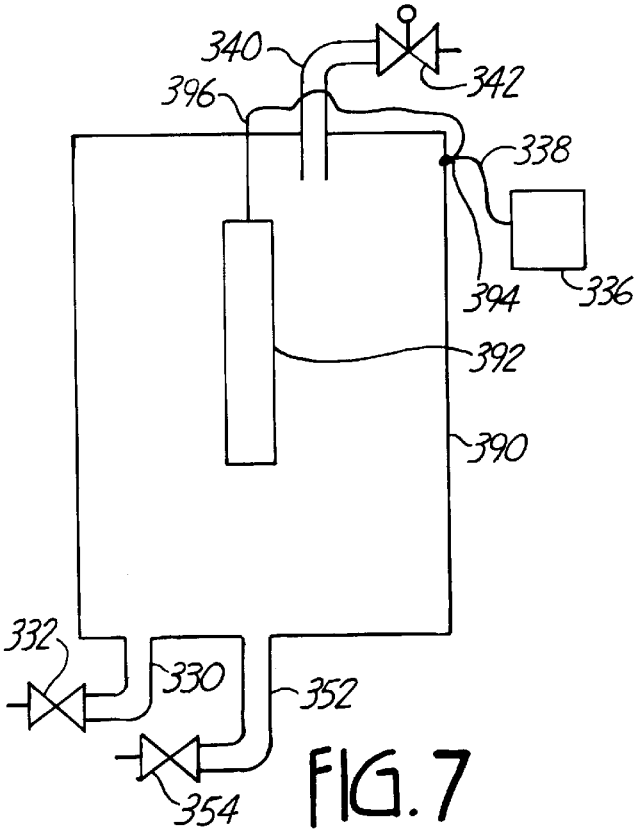
FIG. 7 is a schematic sectional view of an alternative embodiment of a tank with associated electrodes for RF transmission, where the cross section is taken through the center of the tank.

An alternative embodiment of separation tank 334 is shown in FIG. 7. In this embodiment, vessel 390 is conducting and acts as one electrode for RF transmission. Generally, Vessel 390 is grounded. Central electrode 392 is placed within tank 390. Central electrode 392 generally is used as the high voltage electrode for RF transmission. Central electrode 392 can be replaced with a plurality of electrodes and/or moved to other locations within tank 390 to achieve desired levels of heating. Tank 390 and central electrode 392 are connected to cable 338 and RF generator 336 by way of wires 394, 396, respectively.

Figure 8:
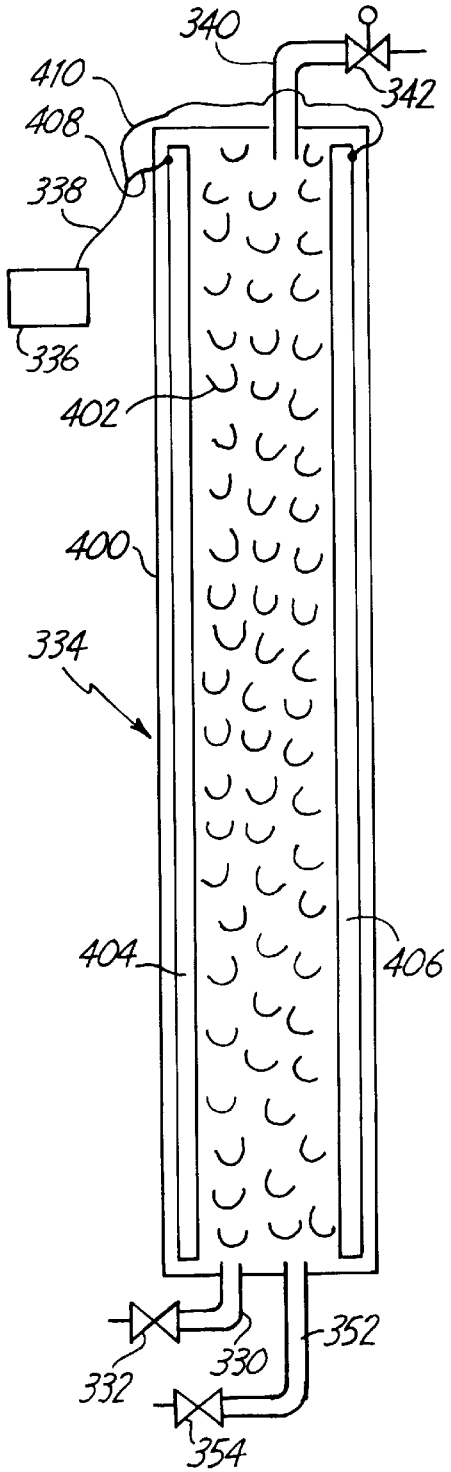
FIG. 8 is a schematic sectional view of an alternative embodiment of a tank with associated electrodes for RF transmission, where the tank includes high surface area materials within and where the cross section is taken through the center of the tank.

An alternative embodiment of separation tank 334 is shown in FIG. 8. In this embodiment, separation tank 334 includes an elongated vessel 400. High surface area members 402 are located within tank 400. High surface area members 402 can be, for example, c-cups, rods, wool, random shaped protrusions projecting from the inside surface of tank 400, or the like. High surface area members 402 that are not intrinsic parts of the wall of tank 400 generally can be poured or placed into tank 400 in a random fashion. High surface area members 402 preferably are made from materials that transmit RF radiation including, for example, glass and plastics such as Teflon®. High surface area members 402 provide surfaces for the vaporization of heated solvent and volatiles within vessel 400.

Elongated electrodes 404, 406, such as planar electrodes, can be placed within elongated vessel 400. Elongated electrodes 404, 406 are connected to cable 338 using wires 408, 410. A suitable RF generator 336 was described above in reference to FIG. 4. Vessel 400 can be made from metal if electrodes 404, 406 are electrically insulated from vessel 400. Then, vessel 400 provides shielding from the RF radiation. Vessel 400 can be one of the electrodes if desired. Similarly, a plurality of electrodes of various shapes and placement can be used as desired. Vessel 400 can be made from electrically insulating material, if desired. If vessel 400 is made from electrically insulating material, the electrodes can be place on the outside of vessel 400 as an alternative to placing the electrodes within the vessel.

Preferably, substantially all of the solvent is removed from the contaminant/oil product, such that the contaminant can be recycled or incinerated. In particular, the recovered contaminant contains preferably less than about 1 percent by weight solvent, more preferably less than about 0.5 percent by weight solvent, and even more preferably less than about 0.25 percent by weight solvent.

Similarly, substantially all volatile components of said contaminant product is removed from the residual contaminant product. Volatile components, such as gasoline, have a significant vapor pressure at room temperature and atmospheric pressure, or more specifically at Standard Temperature and Pressure. Preferably, the volatile compounds removed from the contaminants include compounds with boiling points below 100° C., and more preferably below 150° C. Volatile compounds with flash points between 10° C. and 70° C. are preferably removed. Preferably, the recovered contaminant contains less than about 1 percent by weight flammable, volatile components, more preferably less than about 0.5 percent by weight flammable, volatile components, and even more preferably less than about 0.25 percent by weight flammable, volatile components. In addition, the recovered contaminant preferably contains less than about 5 percent by weight water and other inflammable, volatile contaminants.

Recovered oil preferably has a flash point greater than 142° F. such that it would not be classified as a hazardous material. More preferably, recovered oil has a flash point greater than about 145° F. Generally, recovered oil preferably has a flash point between about 145° and about 350° F.

In operation, the condiment/solvent mixture is first processed in primary distillation column 300. Primary distillation column is pressurized and has a boiler that vaporizes solvent from the extracted oils. Secondary distillation column 320 operates at lower pressures than primary distillation column 300. After processing the contaminants in the primary distillation column 300, the residual contaminant preferably is bled periodically into secondary distillation column 320.

Because secondary distillation column 320 operates at a lower pressure than primary distillation column 300, additional volatile components of the contaminant mixture can be removed. Both distillation columns 300, 320 can include a horizontal boiler below a vertical column. The boiler can be heated with hot water or oil flowing through a heat exchanger positioned to heat the contaminant mixture. Solvent vapor from the secondary distillation column 320 is condensed at the solvent compressor 322.

The remaining contaminant materials from secondary distillation column 320 flows to separation tank 334. RF heating is used to reduce further the amount of volatile compounds in the contaminant/oil materials. The RF heating in separation tank 334 is continued until the amount of volatiles in the contaminant/oil material is reduced to acceptable levels. The purified contaminant/oil is placed into holding tank 358 until recycled. Mixtures of volatile contaminants and solvent removed from separation tank 334 can be separated to recover solvent for reuse.

The embodiments described above are intended to be illustrative and not limiting. Additional embodiments are within the claims. Although the present invention has been described with reference to preferred embodiments, workers skilled in the art will recognize that changes may be made in form and detail without departing from the spirit and scope of the invention.

What is claimed is:

1. A method for cleaning and drying a material within a vessel sealed from the ambient environment, the vessel being operably connected to a condenser, the method comprising:

flowing a solvent through the vessel containing the material to be cleaned;

draining the solvent from the vessel; and applying radio frequency electromagnetic radiation to the vessel to evaporate residual solvent within the vessel, where the solvent is condensed by the condenser and collected within a storage tank.

2. The method of claim 1 wherein the solvent is a gas at Standard Temperature and Pressure.

3. The method of claim 1 wherein the solvent comprises a hydrocarbon or a substituted hydrocarbon.

4. The method of claim 1 wherein the solvent comprises a compound selected from the group consisting of dimethyl ether, butane, isobutane, pentafluoroethane, 1,1-difuoroethane, 1,1,1,2-tetrafluoroethane, 1,1,1-trifluoroethane, 1,1,2,2-tetrafluoroethane, 2-chloro-1,1,1,2-tetrafluoroethane, 1-chloro-1,1-difluoroethane, 1,1,2-trifluoroethane, 1,1-dichloro-1-fluoroethane, chloro difluoro methane, trichloroethylene, perchloro ethylene, trichloroethane and chloroethane.

5. The method of claim 1 wherein the radiation is applied until no more than about 1 percent by weight of the mass in the vessel is solvent.

6. The method of claim 1 wherein the material comprises a sorbent material.

7. The method of claim 1 wherein the material comprises a granular sorbent.

8. The method of claim 1 wherein the material comprises sorbent mats, pads or cloth.

9. The method of claim 1 wherein the material is in a basket within the sealed vessel.

10. The method of claim 9 wherein the basket is an electrode for the application of electromagnetic radiation.

11. The method of claim 9 wherein the basket does not conduct electricity.

12. The method of claim 11 wherein opposing electrodes are mounted on the basket.

13. A method for removing volatile components from an oil, the method comprising:

irradiating a mixture of liquid oil and volatile compounds within a first tank with radio frequency electromagnetic radiation; and collecting the volatile compounds in a second tank following condensation.

14. The method of claim 13 wherein the tank comprises a high surface area material within the tank.

15. The method of claim 13 wherein the radiation is generated by electrodes placed around the tank.

16. The method of claim 13 wherein the high surface area material comprises glass.

17. The method of claim 15 wherein the tank comprises fiberglass.

18. The method of claim 13 wherein the electrodes are located within the first tank.

19. The method of claim 13 wherein the oil following collection of the volatile compounds in the second tank has a flash point greater than 142° F.

20. The method of claim 13 wherein the oil following collection of the volatile compounds in the second tank has less than about 1 percent by weight flammable, volatile components.

* * * * *

UNITED STATES PATENT AND TRADEMARK OFFICE

CERTIFICATE OF CORRECTION

PATENT NO. : 6,098,306
DATED : August 8, 2000
INVENTOR(S) : Ramsey et al.

It is certified that error appears in the above-identified patent and that said Letters Patent is hereby corrected as shown below:

Column 14, Claim 15,
Line 38, after "claim", replace "13" with -- 14 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*